US005816891A

United States Patent [19]

Woo

[11] Patent Number: 5,816,891

[45] Date of Patent: Oct. 6, 1998

[54] PERFORMING CHEMICAL MECHANICAL POLISHING OF OXIDES AND METALS USING SEQUENTIAL REMOVAL ON MULTIPLE POLISH PLATENS TO INCREASE EQUIPMENT THROUGHPUT

[75] Inventor: Christy M.-C. Woo, San Jose, Calif.

[73] Assignee: Advanced Micro Devices, Inc., Sunnyvale, Calif.

[21] Appl. No.: 789,978

[22] Filed: Jan. 28, 1997

Related U.S. Application Data

[62] Division of Ser. No. 470,519, Jun. 6, 1995, abandoned.

[51] Int. Cl.[6] ..... B24B 1/00; B24B 49/03; B24B 49/12

[52] U.S. Cl. ..... 451/6; 451/36; 451/41; 451/56; 451/57; 451/59; 451/63

[58] Field of Search ..... 451/36, 41, 56, 451/57, 59, 63, 65, 66, 72, 5, 6

[56] References Cited

U.S. PATENT DOCUMENTS

| | | | |
|---|---|---|---|
| 3,874,129 | 4/1975 | Deckert et al. | 451/57 X |
| 4,141,180 | 2/1979 | Gill, Jr. et al. . | |
| 4,193,226 | 3/1980 | Gill, Jr. et al. . | |
| 4,680,893 | 7/1987 | Cronkhite et al. . | |
| 5,361,545 | 11/1994 | Nakamura | 451/287 |
| 5,433,650 | 7/1995 | Winebarger | 451/6 |
| 5,456,627 | 10/1995 | Jackson et al. | 451/11 |
| 5,498,199 | 3/1996 | Karlsrud et al. | 451/289 |
| 5,547,415 | 8/1996 | Hasegawa et al. | 451/44 |
| 5,605,487 | 2/1997 | Hileman et al. | 451/41 X |

FOREIGN PATENT DOCUMENTS

| | | | |
|---|---|---|---|
| 547894 | 6/1993 | European Pat. Off. | 451/290 |
| 2523375 | 9/1976 | Germany | 451/6 |
| 5-177533 | 7/1993 | Japan | 451/290 |
| 6-47657 | 2/1994 | Japan | 451/290 |

*Primary Examiner*—Timothy V. Eley
*Attorney, Agent, or Firm*—Sawyer & Associates

[57] ABSTRACT

A chemical mechanical polisher is provided comprising multiple polish platens to sequentially remove any fixed amount of oxide or metal on a semiconductor wafer. Each polish platen polishes a fraction of the total oxide removed. Total oxide removal is achieved after completing polishing on all available polish platens assigned for polishing. Reduced oxide removed enables a high oxide removal rate on each polish platen, thus reducing polish time. Sequential polishing on multiple polish platens reduces polish time especially for high oxide removal in the range greater than 0.5 micrometer to greater than 1 micrometer. A higher polish rate and shorter polish time results in shorter polish pad conditioning time. Multiple polish platens coupled with more than one consecutive wafer-carrier head, each following the previous wafer-carrier head in completing sequential polishing, improves machine throughput by eliminating machine idle time caused by events other than actual oxide or metal polishing. The throughput can be further increased by polishing more than one wafer simultaneously at the same polish platen by: (1) employing wafer-carrier heads that hold a set of wafers, (2) providing sets of wafer-carrier heads which follow the same path simultaneously and polish simultaneously at the same polish platen or (3) employing a combination of both methods. The polishing of metals enables use of different polish pad materials and slurry chemistries for each polish platen.

20 Claims, 5 Drawing Sheets

TABLE 1: Tool Sequence for Two Wafer-Carrier Heads and Three Wafer-Polish Platens

| | Time from Start (Seconds) | | | | | | | | | | | | | | | |
|---|---|---|---|---|---|---|---|---|---|---|---|---|---|---|---|---|
| | 0 | 10 | 75 | 110 | 120 | 140 | 185 | 205 | 225 | 230 | 235 | 245 | 250 | 315 | 340 | 345 |
| Polish Platen 1 | | C1W1 Starts Polish | 5 Secs into Cond | | C2W2 Starts Polish | C2W2 20 Secs into Polish | Cond for 5 Secs | Cond for 25 Secs | Finish Cond | Ready for Wafer | Finish Cond | | C1W3 Starts Polish | Cond for 5 Secs | Cond for 30 Secs | Cond for 35 Secs |
| Polish Platen 2 | | | C1W1 Starts Polish | | C1W1 45 Sec into Polish | Cond for 5 Secs | C2W2 Starts Polish | C2W2 20 Secs into Polish | C2W2 40 Secs into Polish | C2W2 45 Secs into Polish | C2W2 50 Secs into Polish | | Cond for 5 Secs | C1W3 25 Secs into Polish | C1W3 30 Secs into Polish | C1W3 30 Secs into Polish |
| Polish Platen 3 | | | | | | C1W1 Starts Polish | C1W1 45 Secs into Polish | Cond for 5 Secs | Cond for 25 Secs | Cond for 30 Secs | Cond for 35 Secs | | C2W2 Starts Polish | Cond for 5 Secs | Cond for 30 Secs | Cond for 35 Secs |
| Buff Platen | | | | | | | | C1W1 Starts Buff | C1W1 Finish Buff | | | | | C2W2 Starts Buff | | |
| Load | C1W1 Start | | | C2W2 Start | | | | | | | | C1W3 Ends Load | | | | |
| Unload | | | | | | | | | | C1W1 Starts Unload | C1W1 Finish Unload | | | | C2W2 Start | C2W2 Finish |

20

FIG. 8

PERFORMING CHEMICAL MECHANICAL POLISHING OF OXIDES AND METALS USING SEQUENTIAL REMOVAL ON MULTIPLE POLISH PLATENS TO INCREASE EQUIPMENT THROUGHPUT

This is a division of application Ser. No. 08/470,519 filed Jun. 6, 1995 now abandoned.

TECHNICAL FIELD

The present invention relates generally to semiconductor processing, and, more particularly, to chemical mechanical processing and improving the throughput of oxide and metal chemical mechanical polishing tools.

BACKGROUND ART

Chemical mechanical polishing (CMP) is widely accepted for polishing semiconductor wafers. Both oxide CMP and metal CMP are used, respectively, on oxide and metal surfaces supported over a semiconductor substrate.

Oxide CMP is employed to convert a conformal oxide layer deposited on a layer of patterned metal, into a planar oxide surface. Without oxide CMP, the conformal oxide layer conforms to the shape of the layer of patterned metal. Fluctuations in the surface of the conformal oxide layer exist above metal steps in the layer of patterned metal. With oxide CMP, oxide on the surface of a wafer is removed, producing a planar layer of oxide above the metal steps. Accordingly, a second layer of metal deposited on the surface of the planar layer of oxide, will also be have a planar surface.

Metal CMP is employed to convert a conformal metal layer deposited on a layer of patterned oxide, into a planar metal/oxide surface. This planar metal/oxide surface then comprises metal structures surrounded by patterned oxide regions. Ideally, the surface of both the metal structures and the surrounding patterned oxide regions, or field oxide regions, should be planarized. The surface of the metal structures should be flush with the surface of the surrounding field oxide regions.

The main benefit of performing chemical mechanical polishing on oxide which is designed to serve as an inter-dielectric layer between two metal layers, is to achieve global as well as local planarity. Local planarity corresponds to providing planarization over small regions of the wafer surface, while global planarity corresponds to providing planarization over the entire wafer surface.

The challenge involved with performing metal CMP is quite different than for oxide CMP. For oxide CMP, polishing stops on oxide and the goal is to achieve global and local planarity across the semiconductor wafer surface. For metal CMP, polishing stops partly on metal and partly on oxide. The goal is to achieve a planar surface on each of the metal structures which is flush with the surrounding field oxide regions.

Depending on the process design and technology, metal structures can consist of small contact and via openings which range from about 0.3 to about 1 micrometer. Other metal structures can include wide metal lines ranging from about 1 micrometer to about 20 or 30 micrometers, or metal bonding pads which can be as large as about 50 to about 100 micrometers.

Structure dishing or gouging, as well as the erosion of neighboring field oxide regions, is a major concern for metal CMP. Structure dishing, or metal dishing, is characterized by the recessed surface of the metal structures. Metal dishing results from elastic deformations of the polishing pad material, which allows continued polishing beyond the level of the surrounding field oxide surface. Erosion of the neighboring field oxide regions is characterized by oxide thinning and rounding of the edges of the field oxide regions at the surface adjacent to the metal structures. Erosion is caused by increased removal of oxide which results from the transfer of pressure to the oxide surface.

The state of the art method of performing both oxide CMP as well as metal CMP involves polishing a wafer supported in a wafer-carrier head with a polishing pad mounted on a polishing platen. As is well-known in the art, the wafer-carrier head is mounted on a polish arm or spindle. The wafer is held face down in a wafer carrier retaining ring with the back of the wafer attached to the wafer-carrier head by vacuum during load, transport, and unload. Typically the wafer extends about 5 to 7 mils from the wafer-carrier head, while approximately 20 mils of the wafer stays inside the wafer carrier pocket. No vacuum is employed to supported the wafer in the wafer-carrier head during polishing. For polishing, the polish arm will move down and press the wafer with a downward force against the polish pad. During polish, the wafer is caught between the wafer-carrier head and the polish pad. Both the wafer-carrier head and the polish table or polish platen rotate during polish.

Existing oxide CMP tools include tools that offer single wafer processing with a single wafer-carrier head, double wafer processing with dual wafer-carrier heads and multiple wafer processing with multiple wafer-carrier heads. Each process cycle can only process a wafer or set of wafers equivalent to the number of wafer-carrier heads on the tool. All existing oxide CMP tools are configured to process one wafer, two wafers, or multiple wafers using a single polish platen. Current state of the art oxide CMP tools can process one, two or up to five to six wafers simultaneously on a single polish platen. A large polish platen is employed to accommodate more than one wafer. One wafer can be mounted on more than one wafer-carrier head or a set of wafers can be mounted on one or more wafer-carrier heads, each case allowing multiple wafers to be polished simultaneously on a single wafer platen.

The single polish platen approach requires long polish time, especially for large oxide removal. The long polish time required for large oxide removal is primarily due to the degradation of polish rate with time caused by polish pad loading effects. Furthermore, each process cycle time is lengthy because it includes wafer loading, oxide polishing, buffing (optional), wafer-carrier head rinsing, wafer unloading as well as transfer among various parts of the tool. In short, the single polish platen approach wastes a large amount of cycle time in each process cycle to events other than actual oxide polishing.

What is needed is an approach for polishing wafers that provides a higher oxide removal rate and reduces the time during which the polishing platens are idle, thus greatly improving CMP throughput.

DISCLOSURE OF INVENTION

In accordance with the invention, a chemical mechanical polisher is provided with increased throughput. Chemical mechanical polishing of oxide is performed by sequential polishing using multiple polish platens. In each of the sequential polishing steps, a single polish platen polishes a fraction of the total oxide removal target. (Total oxide removal target refers to the total amount of oxide to be removed from a wafer during one complete CMP process cycle.) Total oxide removal is achieved after completing polishing on all available polish platens assigned for polishing. The amount of oxide removed on each polish platen depends on the number of polish platens available for polishing within the tool. Each polish platen has its own slurry supply and polish pad conditioning device, which is required to revive, dress, or recondition the polishing pad for the next wafer.

The chemical mechanical polisher for polishing semiconductor wafers to remove a total amount of material from each of the semiconductor wafers comprises:

(a) at least two polish platens arranged in an arbitrary sequence beginning with a first polish platen and ending with a last polish platen;

(b) a polish pad mounted on each of the polish platens, each of the polish pads removing a fraction of the total amount of material during polishing;

(c) a plurality of wafer-carrier heads, each of the wafer-carrier heads transferring at least one of the semiconductor wafers to each of the polish platens, each of the wafer-carrier heads starting at a different time at the first polish platen, following the arbitrary sequence, and ending at the last polish platen;

(e) an unload station for unloading the semiconductor wafers from each of the wafer-carrier heads after ending polishing at the last polish platen; and (d) a load station for loading each of the wafer-carrier heads with at least one of the semiconductor wafers prior to starting polishing at the first polish platen, each of the wafer-carrier heads proceeding to the load station after completing unloading at the unload station, to receive additional semiconductor wafers for polishing.

For pads used in polishing oxides, each of the polish pads are reconditioned after removing a fraction of the total amount of material during polishing. For pads used in polishing metals, the polish pads do not necessarily have to be reconditioned; the need for reconditioning depends on the pad material.

The different time at which each of the wafer-carrier heads starts at the first polish platen is optimized to maximize semiconductor wafer throughput while allowing sufficient polish pad conditioning on each polish pad before additional semiconductor wafers arrive at the polish pad.

The throughput can be further increased by polishing wafers simultaneously at the same polish platen by employing conventional methods. More than one wafer can be polished simultaneously on a single polish platen by: (1) employing wafer-carrier heads that hold a set of wafers, (2) providing sets of wafer-carrier heads which follow the same path simultaneously and polish simultaneously at the same polish platen or (3) employing a combination of both methods.

A thickness measurement station, comprising an optical sensor, may be positioned before the last polish platen to monitor and control the fraction of the total amount of material to be removed.

In the multiple polish platen system of the present invention, each polishing platen has its own set of slurry supply and polishing pad. Thus, both the polishing slurry and polishing pad material can be different for each polish platen. This degree of freedom adds tremendous manufacturing flexibility in metal CMP.

For metal CMP, the factors affecting polishing rate, non-uniformity, planarity, dishing of metal structures, erosion of field oxide, and finishing surface quality of metal and field oxide, are secondarily related to equipment parameter settings. Rather, these factors are primarily dependent on polishing slurry chemistry and polish pad material.

Furthermore, most metal structures are formed with a glue layer deposited underneath a top metal layer so as to act as an adhesion layer, to provide low electrical resistance, or to improve electromigration. Most common glue layers used in integrated circuit manufacturing are titanium (Ti), titanium nitride (TiN), and titanium tungsten. The glue layers are very different than the top metal layer typically comprising tungsten, aluminum, and possibly copper in the future. Accordingly, the polishing behavior of the glue layers can be quite different than their respective top metal layers. Both polishing slurry and pad need to be compatible with the material to be polished in order to achieve the best results.

Still another common use for metal CMP is to form tungsten plugs which serve as contacts and vias between two layers of aluminum metal. As above, glue layers comprising Ti, TiN, or a combination of Ti/TiN, are commonly used in the formation of tungsten plugs. Most commercially available tungsten polishing slurries can polish a tungsten film with at least 3 to 10 times higher removal rate than polishing Ti. With a multiple polish platen system, in this case a three polish platen system, the first polish platen can be set up with a slurry which polishes tungsten, the second polish platen with a slurry which polishes titanium, and the third polish platen can be used as a buff station.

The chemical mechanical polisher of the present invention allows both the polishing slurry and polishing pad material to be different for each polish platen, which is especially important when dealing with aluminum, copper or other metals. Different polishing pads may be beneficial for metal CMP as a softer pad can be used in the first polish platen to allow fast removal of bulk metal material, and then a stiffer polishing pad can be used in the second or third platen to minimize metal dishing and field oxide erosion.

Other objects, features, and advantages of the present invention will become apparent upon consideration of the following detailed description and accompanying drawings, in which like reference designations represent like features throughout the Figures.

BRIEF DESCRIPTION OF THE DRAWINGS

The drawings referred to in this description should be understood as not being drawn to scale except if specifically noted. Moreover, the drawings are intended to illustrate only one portion of an integrated circuit fabricated in accordance with the present invention.

FIG. 8 is a a table illustrating a tool sequence for two and three wafer-carrier heads, respectively.

BEST MODES FOR CARRYING OUT THE INVENTION

Reference is now made in detail to a specific embodiment of the present invention, which illustrates the best mode presently contemplated by the inventor for practicing the invention. Alternative embodiments are also briefly described as applicable.

Figure 1:
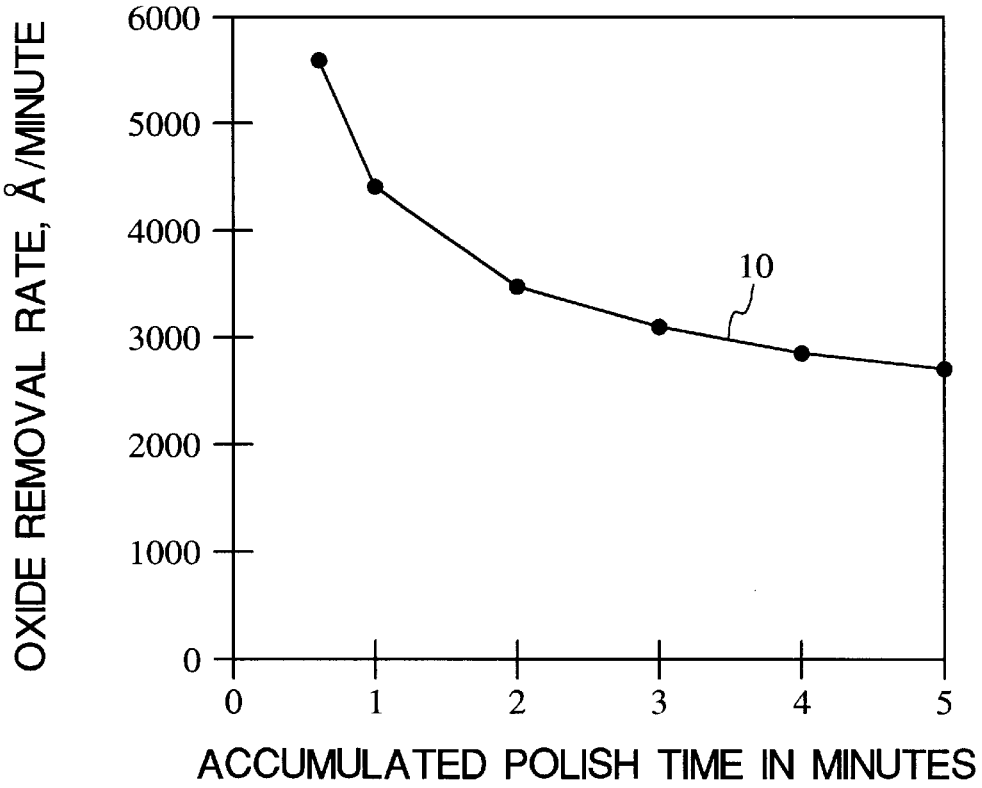
FIG. 1 (PRIOR ART)
FIG. 1, on coordinates of oxide removal rate (in Å/minute) and accumulated polish time (in minutes), is a plot showing the effect of polish time on oxide removal rate.

It is well-known in the art of oxide CMP that oxide removal rate decreases with longer polish time and higher oxide removal, i.e., the amount of oxide removed. The oxide removal rate is highest on a freshly conditioned polish pad. The degradation in oxide removal rate with long polish time and high oxide removal is believed to be caused by the change in the polish pad surface. During polishing, the polish pad becomes loaded with more solids from the polishing slurries, by-products of oxide coming off the wafer, and material coming off the polish pad. FIG. 1 shows the effect of polish time on oxide removal rate. Curve 10 is a plot of oxide removal rate in Å/minute versus accumulated polish time in minutes.

Figure 2:
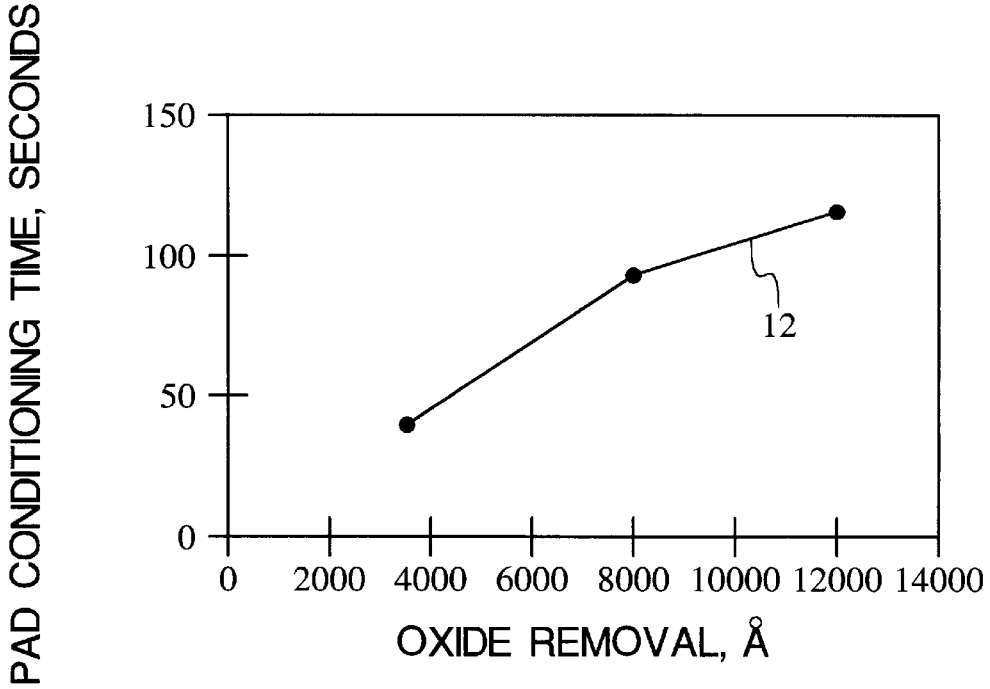
FIG. 2 (PRIOR ART)
FIG. 2, on coordinates of pad conditioning time (in seconds) and oxide removal (in Å), is a plot showing the polish pad conditioning time required to achieve oxide removal rate stability or several ranges of total oxide removal.

It is also well-known and proven in the art that the time needed to condition a polish pad after polishing is proportional to the amount of oxide removed, as well as the length of polish time. FIG. 2 shows the polish pad conditioning time required to achieve oxide removal rate stability for several ranges of oxide removal. Curve 12 is a plot of pad conditioning time in seconds versus total oxide removal in Å.

For any amount of oxide removal, rather than polishing the entire amount of oxide with a polish pad mounted on a single polish platen, the approach of the present invention is to remove the same amount of oxide with several freshly conditioned polish pads mounted on multiple polish platens. The method of the present invention reduces the amount of oxide removed on each polish pad by a factor equal to the number of polish platens available for polish in the tool. When the amount of oxide removed by each polish pad is reduced, shorter polish time is needed. A shorter polish time and smaller amount of oxide removal, results in less polish pad loading. Thus, the highest polish rate produced by a freshly conditioned polish pad can be maintained. This phenomenon is true for any set of processing parameters, e.g., polish arm down force, polish platen rotation speed, wafer carrier rotation speed, slurry flow, and polish platen temperature.

A typical or possible operating range for polish arm down force is, e.g., 2 to 10 pounds per square inch. Polish platen rotation speed can be, e.g., 10 to 150 revolutions per minute (rpm), with both higher and lower rotation speeds possible as well. The range of wafer carrier rotation speed is, e.g., 10 to 150 rpm, with both higher and lower rotation speeds possible. Slurry flow can range from, e.g., 50 to 500 milliliters. Typical range for polish platen temperature can be, e.g., room temperature to 60° C., depending on tool design, slurry, and polish material.

The approach of the present invention is most beneficial to high oxide removal processes, especially for total oxide removal in the range greater than 0.5 micrometer to greater than 1 micrometer.

Figure 3:
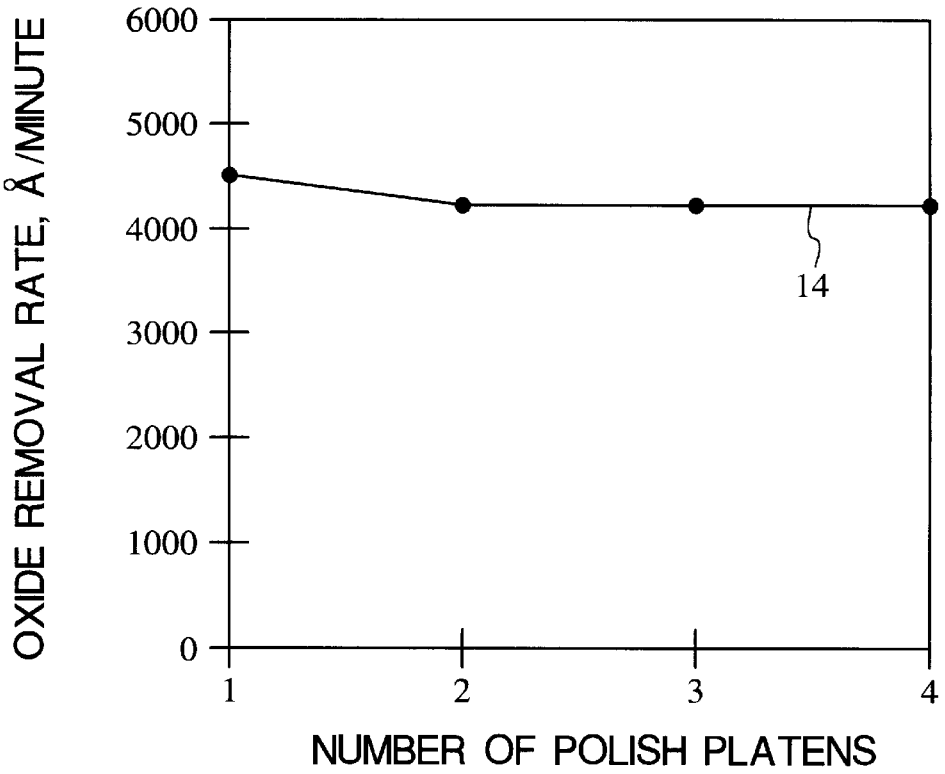
FIG. 3, on coordinates of oxide removal rate (in Å/minute) and number of polish platens, is a plot showing the oxide removal rate achieved on each polish platen for a single polish platen system, a simulated 2 polish platen system, a simulated 3 polish platen system and a simulated 4 polish platen system.
Figure 4:
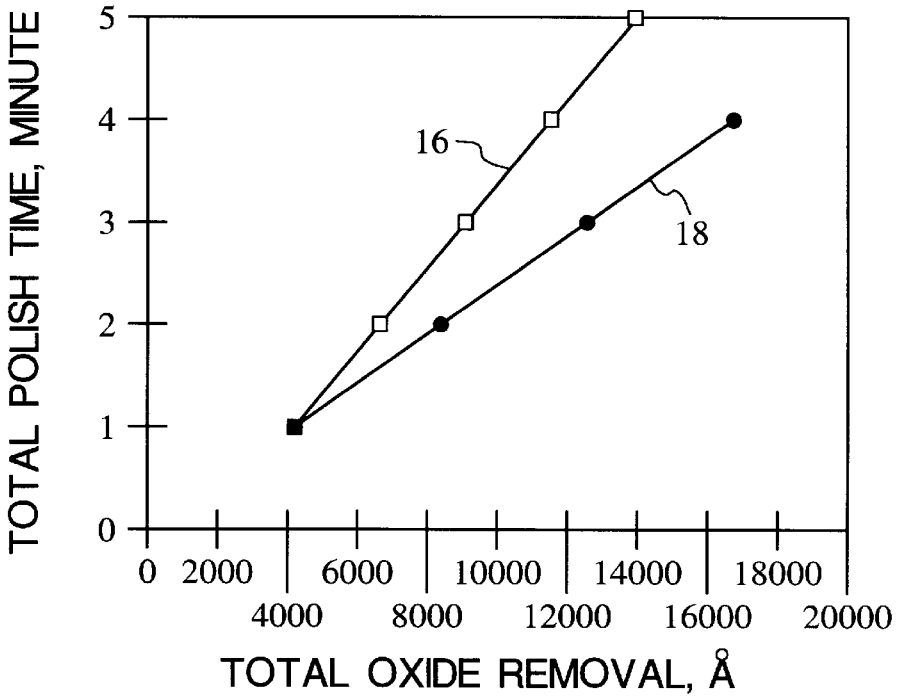
FIG. 4, on coordinates of total polish time (in minutes) and total oxide removal (in Å), is a plot showing a comparison of total polish time versus total oxide removal for a single polish platen system and multiple polish platen systems.

FIG. 3 shows the oxide removal rate achieved on each polish platen for a single polish platen system, a simulated 2 polish platen system, a simulated 3 polish platen system, and a simulated 4 polish platen system. Curve 14 is a plot of oxide removal rate in Å/minute versus number of polish platens. FIG. 4 shows a comparison of polish time versus total oxide removal, i.e., the total amount of oxide removed, for a single polish platen system (curve 16) and multiple polish platen systems (curve 18). For the multiple polish platen systems, the polish time on each polish platen is 1 minute.

With reduced oxide removal targets for each polish pad, a higher polish rate and shorter polish time results in shorter polish pad conditioning time. Conditioning time can be reduced from about 100 seconds to about 20 to 30 seconds with the multiple polish platen system. The polish pad life is extended, as well, with the use of multiple polish platens. Less time is required for conditioning the polish pad which involves scraping off the polish pad with a diamond scraper.

There is an added advantage when utilizing multiple wafer-carrier heads with the approach of the present invention. In the case of the present invention, by multiple wafer-carrier heads is meant a plurality of wafer-carrier heads wherein each wafer-carrier head follows the previous wafer-carrier head in completing sequential polishing using multiple polish platens. Consecutive wafer-carrier heads will lag each other by a certain time period which is carefully planned to allow sufficient polish pad conditioning to be done on each polish pad prior to the arrival of additional wafers. The term, multiple wafer-carrier heads, hereinafter refers accordingly to such an arrangement of a plurality of wafer-carrier used for sequential polishing.

With multiple wafer-carrier heads, each wafer-carrier head will get one wafer, or possibly a set of wafers, as discussed below, and perform polishing on one polish platen at a time. Each wafer will begin on the first polish platen and complete total oxide removal on the last polish platen available for polishing. When the wafer, or set of wafers, achieves its oxide removal target, i.e., the amount of oxide to be removed, for each polish platen, the polish pad for this polish platen will be conditioned. The polish pad will be fresh and ready for the next wafer-carrier head, which will be carrying a new wafer, or a new set of wafers.

The multiple wafer-carrier head, multiple polish platen approach will allow each polish platen to receive another wafer, or set of wafers, and start the actual polishing as soon as the polish pad conditioning time completes. With short pad conditioning time and continuous supply of new wafers, the polish platens will not be idle at any time. Accordingly, machine throughput is significantly boosted. Careful planning of the sequencing of each polish platen activity, i.e., the timing for wafer load, unload, transfer, and final buff (if required), is needed to achieve this result. In addition, selecting an optimum ratio of wafer-carrier heads to polish platens will be essential to achieving high throughput.

The throughput can be further increased by polishing wafers simultaneously at the same polish platen by employing conventional methods. More than one wafer can be polished simultaneously on a single polish platen by: (1) employing wafer-carrier heads that hold a set of wafers, (2) providing sets of wafer-carrier heads which follow the same path simultaneously and polish simultaneously at the same polish platen or (3) employing a combination of both methods.

Figure 5:
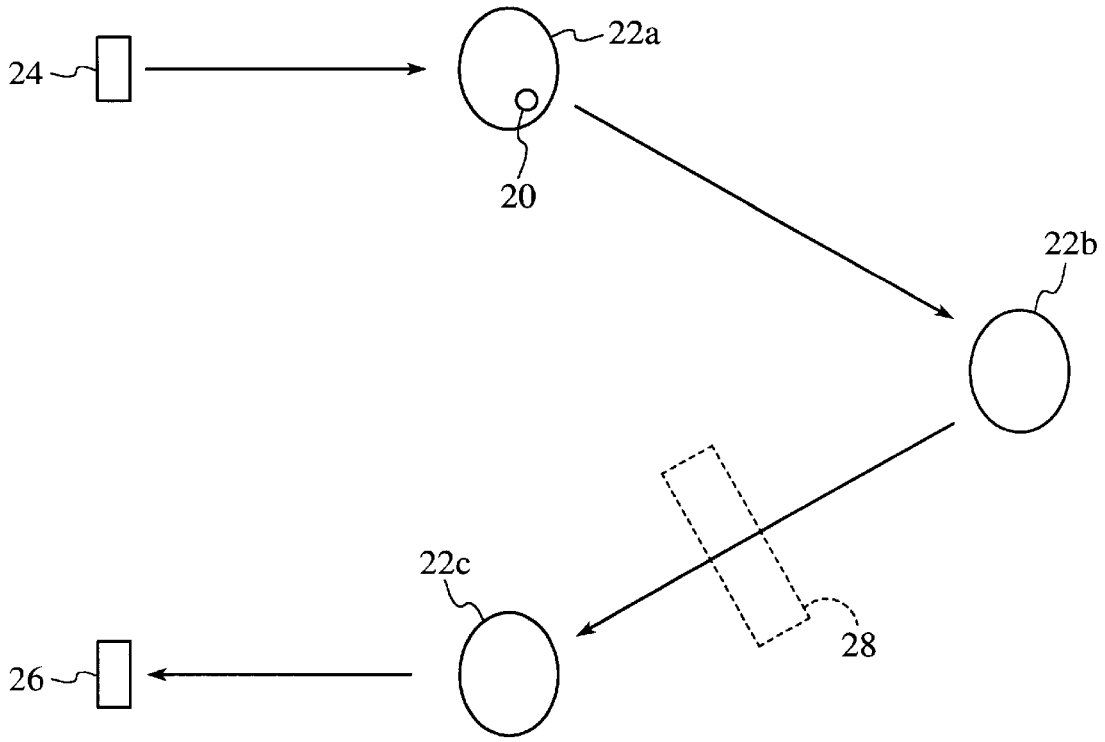
FIG. 5 is a schematic diagram depicting a single wafer processing tool with a single wafer-carrier.
Figure 6:
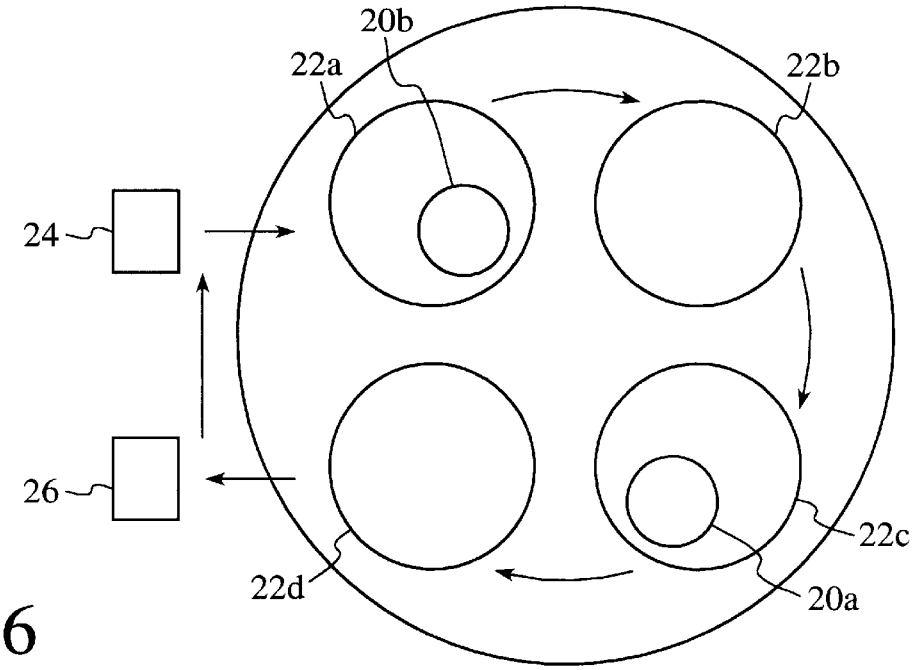
FIG. 6 is a schematic diagram depicting a carousel style multiple polish platen system.
Figure 7:
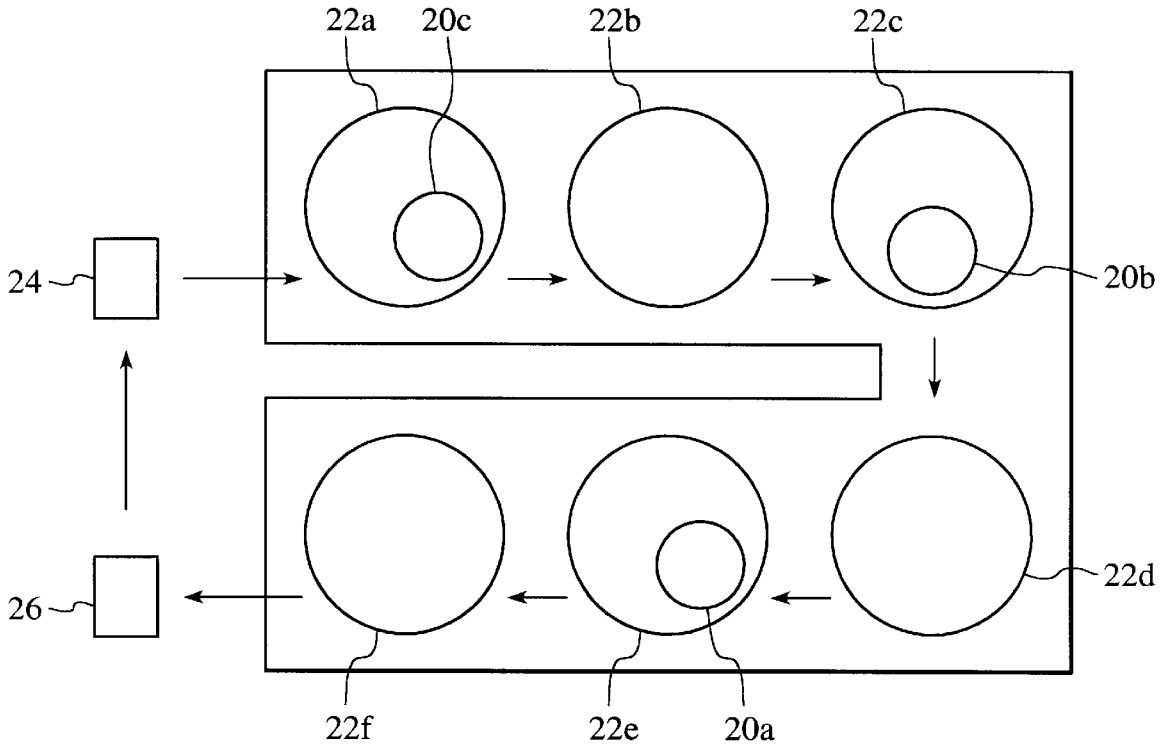
FIG. 7 is a schematic diagram depicting a track style multiple polish platen system.

Example configurations of the multiple polish platen tools of the present invention are depicted in FIGS. 5–7.

FIG. 5 shows one possible configuration of a single wafer processing tool with a single wafer-carrier head. This multiple polish platen tool has one wafer-carrier head 20 and two or more polish platens 22 and allows processing of one wafer per process cycle.

While three polish platens 22 are shown, it will be readily apparent to those skilled in the art that in fact any number of such polish platens, in excess of a single polish platen, can be employed. While one wafer-carrier head 20 is shown, it will be readily apparent to those skilled in the art that in fact each wafer-carrier head in a multiple polish platen system can be replaced with a set of wafer-carrier heads such that more than a single wafer can be polished simultaneously on a single polish platen. Furthermore, while the multiple polish platen tool shown in FIG. 5 allows processing of one wafer per process cycle, it will be readily apparent to those skilled in the art that in fact the wafer-carrier head or wafer-carrier heads can be designed to hold a set of wafers such that more than a single wafer can be polished simultaneously on a single polish platen.

The steps in a process cycle include wafer loading, oxide removal on each polish platen, buffing or rinsing (optional), and wafer unloading. The full cycle ends in wafer unload. Each polish platen 22 will be conditioned by a conditioning device immediately after polishing. The last polish platen, polish platen #3 22*c* in this case, can be used as a buff platen, in which case reconditioning of this polish platen is not required. The arrows in FIG. 5 indicates the path of the wafer-carrier head 20.

At the beginning of the process cycle, the wafer (not shown) is loaded into the wafer-carrier head 20 at the load station 24 and is transferred to polish platen #1 22*a* where polishing begins. FIG. 5 depicts the wafer-carrier head 20 at this stage of the process cycle. After removing a fraction of the total oxide removal target, the wafer-carrier head 20 transfers the wafer to polish platen #2 22*b* for additional polishing. Reconditioning of polish platen #1 22*a* begins immediately after the wafer is removed from this polish platen.

Polish platen #2 22*b* removes the same amount of oxide with a freshly conditioned polish pad. After removing another fraction of the total oxide removal target, the wafer-carrier head 20 transfers the wafer to polish platen #3 22*c* for additional polishing. As before, reconditioning of polish platen #2 22*b* begins immediately after the wafer is removed from this polish platen.

Polish platen #3 22*c* removes the same amount of oxide with a freshly conditioned polish pad. After removing the final fraction of the total oxide removal target, the wafer-carrier head 20 transfers the wafer to the unload station 26 where the wafer is unloaded from the wafer-carrier head. Again, reconditioning of polish platen #3 22*c* begins immediately after the wafer is removed from this polish platen.

For this single wafer processing tool with a single wafer-carrier head 20, the throughput gain from using multiple polish platen will only be the result of polish time reduction by removing a smaller amount of oxide with several polish platens 22 rather than with one polish platen. This tool will benefit processes with total oxide removal in the range greater than 0.5 micrometer to greater than 1 micrometer.

A thickness measurement station 28 can be inserted in the multiple polish platen system before the last polish platen, polish platen #3 22*c* in this case. The thickness measurement station acts as end point control to monitor the oxide removal. The thickness measurement can be used to determine the extent to which the oxide removal target has been achieved by polishing on previous polish platens. Adjustments in the oxide removal target for the last polish platen, i.e., polish platen #3 22*c,* can be made accordingly.

Various techniques can be employed to monitor the oxide thickness, including a variety of optical techniques. Optical sensors for monitoring thickness based on optical interference (e.g., Prometrix FT650) or ellipsometry are two examples of possible means for measuring oxide thickness.

Possible multiple wafer processing tool of the present invention, such as carousel and track style multiple polish platen systems, are shown in FIGS. 6 and 7.

The multiple wafer processing tools of the present invention have two or more consecutive wafer-carrier heads 20, each following the previous wafer-carrier head 20 in completing sequential polishing, and two or more polish platens 22. The process cycle for each wafer-carrier head 20 begins with getting a wafer, or possibly a set of wafers, from the load station 24. Oxide removal is then performed on each polish platen 22 starting from the first polish platen to the last platen available for polish. The process cycle completes when the wafer, or set of wafers, is returned to the unload station 26. The wafer-carrier head 20 will begin another process cycle by returning to the load station 24 and picking up a new wafer, or a new set of wafers. In the multiple wafer processing tool of the present invention, multiple wafer-carrier heads are employed, each wafer-carrier head 20 following the previous wafer-carrier head in completing one full process cycle in the same manner. Consecutive wafer-carrier heads 20 will lag each other by a certain time period which is carefully planned to allow sufficient polish pad conditioning to be done on each polish pad prior to the arrival of the next wafer or the next set of wafers.

As indicated above, the throughput of the multiple wafer processing tools of the present invention can be further increased by polishing wafers simultaneously at the same polish platen by employing conventional methods. More than one wafer can be polished simultaneously on a single polish platen by: (1) employing wafer-carrier heads that hold a set of wafers, (2) providing sets of wafer-carrier heads which follow the same path simultaneously and polish simultaneously at the same polish platen or (3) employing a combination of both methods.

FIG. 6 depicts a carousel style multiple polish platen system of the present invention. This carousel style multiple polish platen tool has two wafer-carrier heads 20 and four polish platens 22.

While two wafer-carrier heads 20 are shown, it will be readily apparent to those skilled in the art that in fact any number of such wafer-carrier heads, in excess of a single wafer-carrier head, can be employed. In fact, each wafer-carrier head in a multiple polish platen system can be replaced with a set of wafer-carrier heads, and/or the wafer-carrier heads can be designed to hold a set of wafers, such that more than a single wafer can be polished simultaneously on a single polish platen. Also, while four polish platens 22 are shown, it will be readily apparent to those skilled in the art that in fact any number of such polish platens, in excess of a single polish platen, can be employed. Furthermore, the ratio of wafer-carrier heads 20 to polish platens 22 is also not limited.

The arrows in FIG. 6 indicate the path of the wafer-carrier head 20. Each polish platen 22 will be conditioned by a conditioning device immediately after polishing. The last polish platen, polish platen #4 22*d* in this case, can be used as a buff platen, in which case reconditioning of this polish platen is not required.

At the beginning of the process cycle, the first wafer (not shown) is loaded into the wafer-carrier head #1 20*a* at the load station 24 and is transferred to polish platen #1 22*a* where polishing begins. After polishing, wafer-carrier head #1 20*a* transfers the first wafer to polish platen #2 22*b* for additional polishing. After polishing at polish platen #2 22*b*, wafer-carrier head #1 20*a* transfers the first wafer to polish platen #3 22*c* for additional polishing.

By this point, the second wafer (not shown) has been loaded into the wafer-carrier head #2 20*b* at the load station 24 and is transferred to polish platen #1 22*a* where polishing of the second wafer occurs simultaneous to polishing of the first wafer at polish platen #3 22*c*. FIG. 6 depicts the wafer-carrier heads 20 at this stage of the process cycle. After polishing is completed for both the first wafer and the second wafer, wafer-carrier head #1 20*a* transfers the first wafer to polish platen #4 22*d* for additional polishing and wafer-carrier head #2 20*b* transfers the second wafer to polish platen #2 22*b* for additional polishing. After polishing is completed for both the first wafer and the second wafer, wafer-carrier head #1 20*a* transfers the first wafer to the unload station 26 where the wafer is unloaded from wafer-carrier head #1 and wafer-carrier head #2 20*b* transfers the second wafer to polish platen #3 22*c* for additional polishing.

Wafer-carrier head #1 20*a* proceeds to the load station 24 where another wafer is loaded into wafer-carrier head #1 and then onto polish platen #1 22*a* for polishing. Wafer-carrier head #1 20*a* then proceeds to repeat the process cycle.

Concurrently, wafer-carrier head #2 20*b* follows wafer-carrier head #1 20*a* in completing the process cycle and beginning a new process cycle with a new wafer.

Each wafer-carrier head continues to repeat the process cycle in order to polish additional wafers. Wafer-carrier head #2 20*b* continues to lag behind wafer-carrier head #1 20*a* for a time period carefully planned to allow sufficient polish pad conditioning. As indicated above reconditioning of the polish platens 22 begins immediately after the wafer is removed from the polish platens.

In the carousel style multiple polish platen system shown the wafer-carrier heads 20 rotate around, for example on a carousel, to move the wafers from polish platen 22 to polish platen. As before, a thickness measurement station 28 can be inserted in the multiple polish platen system before the last polish platen, polish platen #4 22*d* in this case.

With the optimum ratio of wafer-carrier heads 20 to polish platens 22 and careful planning of sequencing, this multiple polish platen system will allow multiple wafer processing with the potential to achieve maximum throughput. Polish pad conditioning time will limit the ultimate machine throughput for this multiple polish platen system.

Two principles enable high throughput to be achieved. First, shorter polish time is required due to a smaller oxide removal target for each polish platen 22. Second, the ability to supply each polish platen 22 with the next wafer without waiting for the previous wafer to complete the full cycle eliminates idle time on all parts of the tool.

FIG. 7 depicts a track style multiple polish platen system of the present invention. This track style multiple polish platen tool has three wafer-carrier heads 20 and six polish platens 22.

While three wafer-carrier heads 20 are shown, it will be readily apparent to those skilled in the art that in fact any number of such wafer-carrier heads, in excess of a single wafer-carrier head, can be employed. In fact, each wafer-carrier head in a multiple polish platen system can be replaced with a set of wafer-carrier heads, and/or the wafer-carrier heads can be designed to hold a set of wafers, such that more than a single wafer can be polished simultaneously on a single polish platen. Also, while six polish platens 22 are shown, it will be readily apparent to those skilled in the art that in fact any number of such polish platens, in excess of a single polish platen, can be employed. Furthermore, the ratio of wafer-carrier heads 20 to polish platens 22 is also not limited.

The arrows in FIG. 7 indicate the path of the wafer-carrier head 20. As above, each polish platen 22 will be conditioned by a conditioning device immediately after polishing. The last polish platen, polish platen #6 22*f* in this case, can be used as a buff platen, in which case reconditioning of this polish platen is not required.

As for the carousel style multiple polish platen system, the first wafer (not shown) is loaded into the wafer-carrier head #1 20*a* at the load station 24 and is transferred to polish platen #1 22*a* where polishing begins. Wafer-carrier head #1 20*a* proceeds to polish platen #2 22*b* and polish platen #3 22*c* for polishing in a similar fashion as described above.

By this point, the second wafer (not shown) has been loaded into the wafer-carrier head #2 20*b* at the load station 24 and is transferred to polish platen #1 22*a* where polishing of the second wafer occurs simultaneous to polishing of the first wafer at polish platen #3 22*c*. After polishing is completed for both the first wafer and the second wafer, wafer-carrier head #1 20*a* proceeds to polish platen #4 22*d* and polish platen #5 22*e* for polishing and wafer-carrier head #2 20*a* proceeds to polish platen #2 22*b* and polish platen #3 22*c* for polishing. By this point, the third wafer (not shown) has been loaded into the wafer-carrier head #3 20*c* at the load station 24 and is transferred to polish platen #1 22*a* where polishing of the second wafer occurs simultaneous to polishing of the first wafer at polish platen #5 22*e* and the second wafer at polish platen #3 22*c*. FIG. 7 depicts the wafer-carrier heads 20 at this stage of the process cycle.

After polishing is completed for the first wafer, the second wafer, and the third wafer, wafer-carrier head #1 20*a* proceeds to polish platen #6 22*f* and to the unload station 26 where the wafer is unloaded from wafer-carrier head #1, wafer-carrier head #2 20*b* proceeds to polish platen #4 22*d* and polish platen #5 22*e* for polishing and wafer-carrier head #3 20*c* proceeds to polish platen #2 22*b* and polish platen #3 22*c* for polishing.

Wafer-carrier head #1 20*a* proceeds to the load station 24 where another wafer is loaded into wafer-carrier head #1 and then onto polish platen #1 22*a* for polishing. Wafer-carrier head #1 20*a* then proceeds to repeat the process cycle.

Concurrently, wafer-carrier head #2 20*b* follows wafer-carrier head #1 20*a* and wafer-carrier head #3 20*c* follows wafer-carrier head #2 20*b* in completing the process cycle and beginning a new process cycle with a new wafer.

Each wafer-carrier head 20 continues to repeat the process cycle in order to polish additional wafers. Wafer-carrier head #2 20*b* continues to lag behind wafer-carrier head #1 20*a* for a time period carefully planned to allow sufficient polish pad conditioning. Simultaneously, wafer-carrier head #3 20*c* continues to lag behind wafer-carrier head #2 20*b* for a time period carefully planned to allow sufficient polish pad conditioning. As indicated above reconditioning of the polish platens 22 begins immediately after the wafer is removed from the polish platens.

In the track style multiple polish platen system shown, the wafer-carrier heads 20 proceed around an arbitrarily shaped track, to move the wafers from polish platen 22 to polish platen. As before, a thickness measurement station 28 can be inserted in the multiple polish platen system before the last polish platen, polish platen #6 22*f* in this case.

EXAMPLES

Simulation of sequential polishing on multiple polish platens 22 was done on a single polish platen system (Westech 372) with a single wafer-carrier head 20 using SC112 oxide polishing slurries. The test wafers used were initially deposited with approximately 27,000 Å of PETEOS (plasma enhanced tetra-ethyl orthosilicate) oxide. Polish pad conditioning was done with an 80 grit diamond disk. Oxide thickness was measured using a Prometrix FT650 with 9 measurement sites per wafer. Four test wafers were sent up to four different times through the single polish platen system. Each time the wafer went through the single polish platen system, it received one minute of polishing on the polish platen 22. The polish pad was immediately conditioned after each polish. The number of times through the single polish platen system simulated the number of polish platens 22 available in a multiple polish platen system. Each test wafer simulated a different number of polish platens 22 available for oxide polish.

Example 1. Single Polish Platen System (Prior Art)

The single polish platen process of the prior art was tested with test wafer #1 cycled through the single polish platen system once. As total polish time was one minute and total oxide removal was 4,469 Å, the oxide removal rate was 4,469 Å/minute.

Example 2. Two Polish Platen System

The two polish platens process of the present invention was tested with test wafer #2 cycled through single polish platen system of Example 1 twice. As total polish time was two minutes and total oxide removal was 8353 Å, the oxide removal rate was 4,177 Å/minute.

Example 3. Three Polish Platen System

The three polish platens process of the present invention was tested with test wafer #3 cycled through single polish platen system of Example 1 three times. As total polish time was three minutes and total oxide removal was 12,388 Å, the oxide removal rate was 4,129 Å/minute.

Example 4. Four Polish Platen System

The four polish platens process of the present invention was tested with test wafer #4 cycled through single polish platen system of Example 1 four times. As total polish time was four minutes and total oxide removal was 16,697 Å, the oxide removal rate was 4,174 Å/minute.

FIG. 3 and partly FIG. 4 (curve 18), which were discussed above, are based on the results obtained from Examples 1–4. In a comparison of one minute polishes for both the single polish platen system and the multiple polish platen systems, polish rates on each platen are all the same, or within range of experimental fluctuation. Curve 16, as discussed above, however, shows that with a five minute uninterrupted polish using the prior art single polish platen system, total oxide removal is less than 14,000 Å. In comparison, simulating the multiple polish platen system with four, one minute polishes, oxide removal is greater than 16,000 Å, as shown in curve 18. Thus, higher total oxide removal and higher oxide removal rates are exhibited by the multiple polish platen systems.

Theoretical Calculations

Theoretical machine throughput calculations demonstrate the advantage of the multiple polish platen system, (both with single wafer-carrier heads 20 and with multiple wafer-carrier heads), over the single polish platen system. Throughput comparisons between (1) a single polish platen system (Westech 372), (2) a multiple polish platen system with a single wafer-carrier head and three polish platens 22, and (3) a multiple polish platen system with two wafer-carrier heads, each following the previous wafer-carrier head in completing sequential polishing, and three polish platens, indicate an increase in throughput for the multiple polish platen system of the present invention.

In the calculations, the load time and unload time are assumed to be 5 seconds each. Transfer between each station, (i.e., load station 24 to polish platen 22, polish platen to polish platen, polish platen to buff platen, buff platen to unload station 26) are also assumed to require 5 seconds. Buff time is assumed to be 20 seconds while 45 seconds of conditioning is assumed to be needed to revive each polish platen 22. No conditioning time is needed for the buffing platen.

For a single polish platen system (Westech 372) with the above assumptions, the total overhead for load, unload, transfer, and buff (optional) is 45 seconds.

The total oxide removal target is 12,388 Å, which is the amount of total oxide removed from test wafer #3. Using the average oxide removal rate for the 4 minute polish, (indicated in FIG. 1 above to be 2,859 Å/minute) and for the 5 minute polish, (indicated in FIG. 1 above to be at 2,771 Å/minute), the normalized time to remove 12,388 Å is 4 minutes, 24 seconds.

The total time to process one wafer, including total polish time (4 minutes, 24 seconds) plus total overhead (45 seconds), is 5 minutes, 9 seconds or 5.15 minutes. Thus the throughput for the single polish platen system is 11.65 wafers/hour.

For a multiple polish platen system with a single wafer-carrier head 20 and three polish platens 22, the total polish time to remove 12,388 Å is 3 minutes, as determined experimentally for test wafer #3. The total overhead time for load, unload, transfer, and buff (optional) is 55 seconds. Accordingly, the total time to process one wafer, including total overhead time and total polish time, is 3 minutes, 55 seconds or 3.92 minutes. Thus the throughput for the multiple polish platen system with a single wafer-carrier head 20 and three polish platens 22 is 15.31 wafers/hour. The throughput increase of multiple polish platen system over the single polish platen system is (15.31 wafers/hour divided by 11.65 wafers/hour) 1.31 or 31%.

For a multiple polish platen system with two wafer-carrier heads 20 and three-polish platens 22, consideration of the entire process sequence is required to determine the total process time for processing two wafers. The total process time is based on the total polish time of 3 minutes to remove 12,388 Å from a single wafer, as determined experimentally for test wafer #3, and the sequence of events in the entire process cycle for the first two wafers polished in the multiple polish platen system with two wafer-carrier heads 20 and three-polish platens 22.

Table 1 shows the entire process sequence for this machine detailing machine status and wafer location at various times after the cycle. Table 1 shows the steps through the entire process cycle for the first two wafers polished. (In Table 1, C1W1 means wafer #1 on wafer-carrier head #1, C2W2 means wafer #2 on wafer-carrier head #2, C1W3 means wafer #3 on wafer-carrier head #1, etc.) As indicated above, oxide polish time on each polish platen 22 is 60 seconds, polish pad conditioning time is 45 seconds and buff time is 20 seconds. Wafer-carrier head #2 20*b* will start loading the second wafer at 110 seconds after the start of the process cycle for wafer #1 on wafer-carrier head #1 20*a*.

Total process time for two wafers in the multiple polish platen system with two wafer-carrier heads 20 and three-polish platens 22 is 6 minutes, 45 seconds or 6.75 minutes. Thus the throughput is 17.78 wafers/hour. The throughput increase of multiple polish platen system over the single polish platen system is (17.78 wafers/hour divided by 11.65 wafers/hour) 1.526 or 52.6%.

The actual throughput increase for the multiple polish platen system with two wafer-carrier heads 20 and three-polish platens 22 is higher than 52.6% when compared to the single polish platen system (Westech 372) with single wafer-carrier head and single polish platen. At the end of the total process time for the first two wafers, i.e., 6 minutes, 45 seconds after start, the third wafer has begun on polish platen #2 22*b* (see Table 1). Thus the actual throughput for the multiple polish platen system with two wafer-carrier heads 20 and three-polish platens 22 is even higher.

INDUSTRIAL APPLICABILITY

The chemical mechanical polisher of the invention is expected to find use in the fabrication of silicon-based semiconductor devices.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. It is possible that the invention may be practiced to remove materials other than oxide from the surface of a semiconductor wafer. The embodiment was chosen and described in order to best explain the principles of the invention and its practical application, thereby enabling others skilled in the art to understand the invention for various embodiments and with various modifications as are suited to the particular use contemplated. It is intended that the scope of the invention be defined by the claims appended hereto and their equivalents.

What is claimed is:

1. A method for performing chemical mechanical polishing on a plurality of semiconductor wafers to remove a total amount of material from each of the plurality of semiconductor wafers comprising the steps of:

providing a plurality of polish platens, each of the plurality of polish platens including a polish pad mounted thereon; and sequentially polishing and transferring each of the plurality of semiconductor wafers in an arbitrary sequence between the plurality of polish platens; the plurality of polish pads including a start polish pad for starting the polishing of each of the plurality of semiconductor wafers and an end polish pad for ending the polishing of each of the plurality of semiconductor wafers, each of the plurality of polish pads sequentially removing by polishing a substantially equal fraction of the total amount of material on each of the plurality of semiconductor wafers, wherein more than one of the plurality of semiconductor wafer can be polished substantially simultaneously.

2. The method of claim 1 wherein polishing of each of said plurality of semiconductor wafers is started at said start polish pad at different times which are optimized to maximize throughput of said plurality of semiconductor wafers while allowing sufficient polish pad conditioning on each of said plurality of polish pads before another of said plurality of semiconductor wafers arrives at each of said plurality of polish pads.

3. The method of claim 1 wherein said total amount of material comprises material selected from the group consisting of primarily oxide, primarily metal, and primarily oxide and metal.

4. The method of claim 1 wherein said equal fraction of said total amount of material to be removed is monitored before each of said plurality of semiconductor wafers reaches said last polish platen and polishing at said last polish platen is adjusted to control said equal fraction of said total amount of material to be removed such that said total amount of material is removed after ending polishing at said last polish platen.

5. The method of claim 4 wherein said total amount of material to be removed is monitored using an optical sensor that measures oxide thickness based on optical interferometry or ellipsometry.

6. The method of claim 1 wherein each of said plurality of semiconductor wafers is removed from each of said plurality of polish platens for transferring said plurality of semiconductor wafers after polishing, and each of said polish pads is conditioned for a period after each of said plurality of semiconductor wafers is removed therefrom.

7. The method of claim 6 said period for conditioning each of said polish pads is shorter than a period after each of said plurality of semiconductor wafers is polished thereby.

8. The method of claim 1 wherein each of said semiconductor wafers is transferred to each of said polish platens using a wafer-carrier head that can hold at least one said wafer.

9. The method of claim 8 wherein said wafer-carrier head rotates around on a carousel or proceeds around track.

10. The method of claim 8 wherein a set of wafer-carrier heads is used for transferring said semiconductor wafers to each of said polish platens such that more than a single wafer can be polished simultaneously on a single polish platen.

11. The method of claim 1 wherein said last polish platen comprises a buffing platen that is not conditioned.

12. The method of claim 1 wherein each of said polish pads is provided with a different polishing slurry and comprises a different polishing pad material.

13. A method for performing chemical mechanical polishing on a plurality of semiconductor wafers to remove a total amount of material from each of the plurality of semiconductor wafers comprising the steps of:

providing a plurality of polish platens, each of the plurality of polish platens including a polish pad mounted thereon;

sequentially polishing and transferring each of the plurality of semiconductor wafers in an arbitrary sequence between the plurality of polish platens;

the plurality of polish pads including a start polish pad for starting the polishing of each of the plurality of semiconductor wafers and an end polish pad for ending the polishing of each of the plurality of semiconductor wafers, each of the plurality of polish pads sequentially removing by polishing a substantially equal fraction of the total amount of material on each of the plurality of semiconductor wafers, wherein more than one of the plurality of semiconductor wafers can be polished substantially simultaneously, wherein the polishing of each of the plurality of semiconductor wafers is started at different times at the start polish pad to maximize throughput of the plurality of semiconductor wafers while allowing sufficient polish pad conditioning on each of the plurality of polish pads before another one of the plurality of semiconductor wafers arrives at each of the plurality of polish pads.

14. The method of claim 13 wherein each of said plurality of semiconductor wafers is removed from each of said plurality of polish platens for transferring said plurality of semiconductor wafers after polishing, and each of said polish pads is conditioned for a period after each of said plurality of semiconductor wafers is removed therefrom.

15. The method of claim 14 wherein said period for conditioning each said polishing pad is shorter than the period that each said wafer is polished on each said polish platen.

16. The method of claim 13 wherein each of said semiconductor wafers is transferred to each of said polish platens using a wafer-carrier head that can hold at least one said wafer.

17. The method of claim 16 wherein a set of wafer-carrier heads is used for transferring said semiconductor wafers to each of said polish platens such that more than a single wafer can be polished simultaneously on a single polish platen.

18. The method of claim 13 wherein said equal fraction of said total amount of material to be removed is monitored before each of said plurality of semiconductor wafers reaches said last polish platen and polishing at said last polish platen is adjusted to control said equal fraction of said total amount of material to be removed such that said total amount of material is removed after ending polishing at said last polish platen.

19. The method of claim 13 wherein said last polish platen comprises a buffing platen that is not conditioned.

20. The method of claim 13 wherein each of said polish pads is provided with a different polishing slurry and comprises a different polishing pad material.

* * * * *